United States Patent [19]

Nakamura et al.

[11] Patent Number: 4,783,245

[45] Date of Patent: Nov. 8, 1988

[54] PROCESS AND APPARATUS FOR PRODUCING ALLOY CONTAINING TERBIUM AND/OR GADOLINIUM

[75] Inventors: Eiji Nakamura, Aichi; Katsuhisa Itoh; Shigeaki Sasaki, both of Nagoya; Masahiro Nishio, Tajimi; Mikio Sakakibara, Chiryu, all of Japan

[73] Assignee: Sumitomo Light Metal Industries, Ltd., Tokyo, Japan

[21] Appl. No.: 25,272

[22] Filed: Mar. 12, 1987

[30] Foreign Application Priority Data

Mar. 25, 1986 [JP] Japan ..... 61-66164
Mar. 26, 1986 [JP] Japan ..... 61-67934
Mar. 26, 1986 [JP] Japan ..... 61-67935

[51] Int. Cl.[4] ..... C25C 3/36
[52] U.S. Cl. ..... 204/71
[58] Field of Search ..... 204/71, 64 R, 245

[56] References Cited

U.S. PATENT DOCUMENTS 3,524,800 8/1970 Morrice et al. ..... 204/71
3,729,397 4/1973 Goldsmith et al. ..... 204/64 R

FOREIGN PATENT DOCUMENTS 0134305 3/1985 European Pat. Off. .
0177233 4/1986 European Pat. Off. .
2108000 5/1972 France .
967389 12/1978 Japan .

OTHER PUBLICATIONS

"Fused Salt Electrowinning and Electrorefining of Rare-Earth and Ythrium Metals", Morrice et al, Minerals Sci. Engng, vol. 11 #3, Jul. 1979, pp. 125-136.

*Primary Examiner*—R. L. Andrews
*Attorney, Agent, or Firm*—Parkhurst, Oliff & Berridge

[57] ABSTRACT

A process and an apparatus for producing an alloy containing terbium (Tb) and/or gadolinium (Gd). The process includes the steps of: (a) preparing a bath of molten electrolyte which consists essentially of 20-95% by weight of $TbF_3$ and/or $GdF_3$, 5-80% of LiF, up to 40% of $BaF_2$ and up to 20% of $CaF_2$; (b) reducing the $TbF_3$ and/or $GdF_3$ in the bath, with carbon anode and with cathode made of a metal such as iron or cobalt, so as to electrodeposit Tb and/or Gd on the cathode, and alloying the electrodeposited Tb and/or Gd with metal of the cathode so as to produce the alloy containing Tb and/or Gd in a liquid state on the cathode; (c) adding the $TbF_3$ and/or $GdF_3$ to the bath so as to maintain the composition of the bath, for compensating for consumption of the $TbF_3$ and/or $GdF_3$ during production of the alloy; (d) dripping the liquid alloy from the cathode into a receiver having a mouth which is open upward in a lower portion of the bath below the cathode, and thereby collecting the liquid alloy in the form of a molten pool in the receiver; and (e) withdrawing the molten pool of the liquid alloy from the receiver.

21 Claims, 2 Drawing Sheets

PROCESS AND APPARATUS FOR PRODUCING ALLOY CONTAINING TERBIUM AND/OR GADOLINIUM

BACKGROUND OF THE INVENTION

1. Field of the Art

The present invention relates to a process and an apparatus for producing an alloy containing terbium and/or gadolinium, and more particularly to such a process for continuously producing an alloy having a high content of terbium and/or gadolinium, and having a low control of both harmful impurities and non-metallic inclusions.

2. Related Art Statement

Terbium (Tb) and gadolinium (Gd) are utilized in the form of a thin-layered amorphous alloy of TbFe, TbCo, GdFe, GdCo, TbFeCo, TbGdFe, TbGdCo, etc. as a material for magnetooptical discs of rare earth type which have been recently studied and developed. These elements are also utilized for addition thereof to other kinds of material. The demand for terbium and gadolinium will be increased in the future. Although terbium or gadolinium in the form of a pure metal can be used to obtain an alloy containing the same, an alloy of terbium or gadolinium with iron, cobalt, or other alloying metal is preferable to handle for the addition thereof to other materials, since metallic terbium and metallic gadolinium have a comparatively high melting point, 1365° C. for terbium and 1313° C. for gadolinium.

Four processes of manufacturing an alloy of a rare earth metal with a metal of high melting point are described below, which are commonly known in the art. All of them, however, can not be satisfactory because of certain inherent disadvantages or problems, as the practical and industrial process operable continuously.

(A) One method requires a rare earth metal or its alloy to be prepared beforehand by means of electrowinning the same in a bath of electrolyte or by means of reducing a rare earth compound with an active metal; then the obtained rare earth or its alloy is melted together with another metal to alloy them:

This method, however, is problematical in the first step of preparing the rare earth or its alloy. In the electrowinning method, two techniques are known (1) electrolysis in an electrolyte bath of fused chrorides (raw materials), and (2) electrolysis of rare earth oxides (raw material) dissolved in an electrolyte bath of fused fluorides. The former technique suffers from the problem of difficulty associated handling of the fused chrorides, and the further problem resulting from the batch style processing which is not suitable for a continuous operation on a large scale. On the other hand, the latter technique has the problem of a low solubility of the oxide in the electrolyte bath, which hinders a continuous electrolysis operation and results in an accumulation of sludge on the bottom of the electrowinning cell. Therefore, for continuous and large scale production it is recommed that the rare earth or its alloy be produced in a liquid state, but it is impractical to raise to an excessively high electrolysis temperatures at which the electrolysis operation is conducted, according to a high melting point of the rare earth to be obtained, since at higher temperatures impurities and non-metallic inclusions more easily enter into the liquid rare earth or its alloy.

On the other hand, the reduction method utilizing an active metal belongs to a batch system and is, therefore, not suitable for continuous and large scale production. Further, this method has the disadvantage of requiring an expensive active metal (reducing agent) as well as expensive materials for the exclusive apparatus used in the method. This method has another disadvantage involving the additional step of removing the residual active agent.

(B) In another method alloying is executed by reducing a mixture of a rare earth compound and a metal compound to be alloyed with the rare earth through utilization a reducing agent (e.g., calcium hydride for a Sm-Co alloy).

This method requires an expensive reducing agent, and is unsuitable for a continuous and large scale operation.

(C) In another method an alloy of rare earth and a metal to be alloyed with the rare earth is electrodeposited on the cathode by electrolytic reduction, which reduction is carried out in a bath of electrolyte by dissolving both a compound of the rare earth and a compound of the metal to be alloyed with the rare earth (See U.S. Pat. No. 3298935.

This method is problematical in that it is difficult to keep the chemical composition of the alloy produced on the cathode uniform over a long period of time during the electrolysis operation. Further, in the case where an oxide is used as a raw material, a problem arises concerning low solubility of the oxide in the electrolyte bath, which hinders a continuous electrolysis operation.

(D) In the so-called consumable cathode method, rare earth is electrodeposited by electrolytic reduction on a consumable cathode of a metal and alloyed with the metal of the cathode, in one step which is executed in a suitable bath of electrolyte composed of fused salts See "U.S. Bur. of Min., Rep. of Invest.", No. 7146, 1968, and Japanese patents No. 837401 and 967389).

The shortcomings will be described hereinafter. In the case where a rare earth oxide is used as a raw material to be reduced, the method as stated previously suffers problems, of a low solubility of the rare earth oxide in the selected electrolyte bath and of an accumulated sludge of the oxide; moreover, conducting the electrolysis operation at increased temperatures in order to overcome those problems results in producing a deteriorated alloy containing an increased amount of impurities and non-metallic inclusions which impurities come from the structural materials of the electrowinning cell. Further, the recovery of the produced alloy is carried out in a batch style which is unsuitable for a continuous and large-scale operation.

Metallic terbium and metallic gadolinium have been, in fact, almost useless, and the industrial manufacturing process of obtaining the same has not been settled, except for the above-mentioned reduction method (A) in which terbium or gadolinium can be produced in a small quantity. However, the reduction method is not satisfactory in that the residual reducing agent (calcium) and the impurities (e.g., oxygen) are harmful to the "target" product, terbium or gadolinium. Therefore, it can be said that no industrially practical process is firmly established for continuously producing such metals.

SUMMARY OF THE INVENTION

It is, therefore, an object of the present invention to provide a process and an apparatus for producing an alloy containing terbium and/or gadolinium, which process and apparatus are suitable for a continuous and large-scale production. In particular a reliable, economical industrial process and apparatus for producing such an alloy with high content of terbium and/or gadolinium, and with low content of non-metallic inclusions and impurities such as calcium and oxygen is provided.

According to a first aspect of the present invention, there is provided a process of producing an alloy containing terbium and/or gadolinium, comprising the steps of: (a) preparing a bath of molten electrolyte which has a composition consisting essentially of 20–95% by weight of terbium fluoride and/or gadolinium fluoride, 5–80% by weight of lithium fluoride, up to 40% by weight of barium fluoride and up to 20% by weight of calcium fluoride; (b) effecting electrolytic reduction of the terbium and/or gadolinium fluorides in the bath of molten electrolyte, with at least one carbon anode and at least one metal cathode, so as to electrodeposit terbium and/or gadolinium on the at least one metal cathode, and alloying the electrodeposited terbium and/or gadolinium with metal of the at least one metal cathode so as to produce the alloy containing terbium and/or gadolinium in a liquid state on the at least one metal cathode; (c) adding the terbium and/or gadolinium fluorides to the bath of molten electrolyte so as to maintain the composition of the bath of molten electrolyte, for compensating for consumption of the terbium and/or gadolinium fluorides during production of the alloy; (d) dripping the liquid alloy from the at least one metal cathode into a receiver having a mouth which is open upward in a lower portion of the bath of molten electrolyte below the metal cathode, and thereby collecting the liquid alloy in the form of a molten pool in the receiver; and (e) withdrawing the molten pool of the liquid alloy from the receiver.

In the above-mentioned process according to the present invention, an alloy containing terbium and/or gadolinium can be manufactured in only one step of electrolytic reduction. In this one step of electrolytic reduction, an alloy of high content with a terbium and/or gadolinium and with a low content of impurities (e.g., oxygen) and non-metallic inclusions that adversely affect the properties of magnetooptical disks, permanent magnets, or other end products, can be manufactured in an economical, continuous and large-scale operation. According to the present invention, alloys such as a terbium-iron alloy, terbium-cobalt alloy, gadolinium-iron alloy, gadolinium-cobalt alloy, terbium-gadolinium-iron alloy, and terbium-gadolinium-cobalt alloy can be produced. The invented method has various advantages. For example, use of a solid cathode allows easy handling of the same; siphoning the produced alloy in a liquid state in the course of the electrolysis or electrowinning makes it possible to continue the electrolysis substantially without interruption, i.e., a continuous operation of the electrolyiis is attainable; and the advantage of the use of so-called consumable cathode is fully attainable, i.e., a continuous operation of the electrolysis under lower temperatures remarkably improves the electrolysis results or yields, and also improves the grades of the produced alloys owing to a decreased amount of impurities such as oxygen.

The method according to the present invention allows an enlarged scale of operation and a longer time of operation which improvements have been regarded impossible in reduction processes using an active metal such as calcium. Also, the method effectively restricts the entering of impurities such as the active metal into the produced alloy. It further allows the fundamental elimination of difficulties observed in the continuous operation of electrolytic manufacturing methods executed with a mixture of fused salts of fluoride and oxide(s), and with terbium oxide used and/or gadolinium oxide as the raw material.

The method of the present invention allows the electrolysis operation to be carried out at lower temperatures than the method using terbium oxide and/or gadolinium oxide as the raw material. Operation at lowered temperatures is advantageous in that impurities and non-metallic inclusions which come from the structural materials of the electrowinning cell are effectively restricted. Another advantage of this method resides in the capability of using a higher anode current density than the method using the oxide or oxides, at the same temperature. That is, in the case where the present method and the method using the oxide(s) employ an anode with the same dimensions, the present method is permitted to use a higher current density, thereby assuring better productivity.

In an advantageous embodiment of the above-mentioned process of the present invention, the at least one metal cathode is formed of a metal which is easily alloyed with terbium and/or gadolinium; for example, iron, cobalt, copper, nickel, manganese, chromium, or titanium is used.

According to a preferred embodiment of the above-mentioned process of the present invention, the terbium and/or gadolinium fluorides is terbium fluoride, the at least one metal cathode is formed of iron, and the alloy containing terbium and/or gadolinium is a terbium-iron alloy. In this case, the bath of molten electrolyte is preferably held at temperatures within a range of 860°–1000° C., and the electrolytic reduction may be effected at those temperatures.

According to another embodiment of the invention process, the terbium and/or gadolinium fluorides is terbium fluoride, the at least one metal cathode is formed of cobalt, and the alloy is a terbium-cobalt alloy. In this case, the bath of molten electrolyte is preferably held at temperatures within a range of 710°–1000° C. and the electrolytic reduction may be effected at those temperatures.

According to still another embodiment of the process, the terbium and/or gadolinium fluorides is gadolinium fluoride, the at least one metal cathode is formed of iron, and the alloy is a gadolinium-iron alloy. In this case, the bath of molten electrolyte is preferably held at temperatures within a range of 850°–1000° C., and the electrolytic reduction may be effected at those temperatures.

According to yet another embodiment of the process of the present invention, the terbium and/or gadolinium fluorides is gadolinium fluoride, the at least one metal cathode is formed of cobalt, and the alloy is a gadolinium-cobalt alloy. In this case, the bath of molten electrolyte is preferably held at temperatures within a range of 800°–1000° C., and the electrolytic reduction may be effected at those temperatures.

According to a further embodiment of the process, the terbium and/or gadolinium fluorides is a mixture of terbium fluoride and gadolinium fluoride, the at least one metal cathode is formed of iron, and the alloy is a terbium-gadolinium-iron alloy. In this case, the bath of molten electrolyte is preferably held at temperatures within a range of 850°–1000° C., and the electrolytic reduction is effected at those temperatures.

According to a yet further embodiment of the process, the terbium and/or gadolinium fluorides is a mixture of terbium fluoride and gadolinium fluoride, the at least one metal cathode is formed of cobalt, and the alloy is a terbium-gadolinium-cobalt alloy. In this case, the bath of molten electrolyte is preferably held at temperatures within a range of 710°–1000° C., and the electrolytic reduction is effected at those temperatures. According to an embodiment of the process of the present invention, the terbium and/or gadolinium fluorides is terbium fluoride, and the electrolytic reduction is effected by applying a direct current to the at least one carbon anode with a current density of 0.05–10.0 A/cm$^2$, and to the at least one metal cathode with a current density of 0.50–80 A/cm$^2$.

According to another embodiment of the process of the present invention, the terbium and/or gadolinium fluorides is gadolinium fluoride, and the electrolytic reduction is effected by applying a direct current to the at least one carbon anode with a current density of 0.05–4.0 A/cm$^2$, and to the at least one cathode with a current density of 0.50–80 A/cm$^2$.

According to another embodiment of the process of the present invention, the terbium and/or gadolinium fluorides is a mixture of terbiun fluoride and gadolinium fluoride, and the electrolytic reduction is effected by applying a direct current to the at least one carbon anode with a current density of 0.05–10.0 A/cm$^2$, and to the at least one cathode with a current density of 0.50–80 A/cm$^2$.

In a further embodiment of the process, the at least one carbon anode is formed of graphite.

In a yet further embodiment of the process, the at least one metal cathode is an eoongate solid member having a substantially constant transverse cross sectional shape over its length.

In a preferred embodiment of the process, the at least one metal cathode is an elongate tubular member having a substantially constant transverse cross sectional shape over its length.

According to an embodiment of the process of the present invention, the bath of electrolyte containing the terbium and/or gadolinium fluorides consists essentially of at least 25% by weight of terbium fluoride and/or gadolinium fluoride, and at least 15% by weight of lithium fluoride.

According to a second aspect of the present invention, there is an apparatus for producing an alloy containing terbium and/or gadolinium, comprising: (A) an electrowinning cell formed of refractory materials for accommodating a bath of electrolyte consisting essentially of terbium fluoride and/or gadolinium fluoride, and lithium fluoride, and optionally barium fluoride and calcium fluoride as needed; (B) a lining applied to the inner surface of the electrowinning cell and contacting the bath of electrolyte; (C) at least one elongate carbon anode having a substantially constant transverse cross sectional shape over its length, and projecting into the electrowinning cell such that a lower free end portion of the at least one carbon anode is immersed in the bath of electrolyte; (D) at least one elongate metal cathode having a substantially constant transverse cross sectional shape over its length, and projecting into the electrowinning cell such that a lower free end portion of the at least one metal cathode is immersed in the bath of electrolyte; (E) a receiver having a mouth which is open upward in a lower portion of the electrowinning cell below the free end portion of the at least one metal cathode, the receiver reserving a molten pool of the alloy containing terbium and/or gadolinium which is produced on the at least one metal cathode by means of electrolytic reduction of the terbium and/or gadolinium fluorides with a direct current applied between the at least one carbon anode and the at least one metal cathode, the produced alloy being dripped off the at least one metal cathode into the receiver; (F) siphoning means for withdrawing the molten pool of the alloy from the receiver out of the electrowinning cell; and (G) feeding means for feeding the at least one metal cathode into the bath of electrolyte so as to apply the direct current to the at least one metal cathode with a predetermined current density, for compensating for a wear length of the at least one metal cathode during production of the alloy.

In a preferred embodiment of the above-mentioned apparatus of the present invention, the at least one metal cathode is formed of iron or cobalt.

In another embodiment of the apparatus, the at least one metal cathode is an elongate solid member.

In yet another embodiment of the apparatus, the at least one metal cathode is an elongate tubular member. In this case, the tubular metal cathode may be connected to a protection gas supplying means from which a protection gas is blown into the bath of electrolyte through an opening at a lower end of the at least one metal cathode.

In a further embodiment of the apparatus of the present invention, the apparatus further comprises raw material-supply means for adding the terbium and/or gadolinium fluorides to the bath of electrolyte. In this case, the at least one metal cathode is an elongate tubular member through which the terbium and/or gadolinium fluorides are supplied into the bath of electrolyte, and which thus serves as part of the raw material-supply means.

According to a yet further embodiment of the apparatus, the apparatus further comprises ascent-and-descent means for positioning the at least one carbon anode into the bath of electrolyte so as to apply the direct current to the at least one carbon anode with a predetermined current density, for compensating for a wear length of the at least one carbon anode during production of the alloy.

According to a still further embodiment of the apparatus, the siphoning means comprises a siphon pipe which is disposed so that one end thereof is immersed in the molten pool of the produced alloy in the receiver, the siphoning means further comprising suction means for sucking the liquid alloy under vacuum from the receiver out of the electrowinning cell. This is advantageous in a case of industrialization.

According to another embodiment of the apparatus of the present invention, the lining is formed of a ferrous material. This is advantageous in that the ferrous material costs lower than other refractory metals such as molybdenum and tungsten.

According to a still another embodiment of the apparatus, the at least one carbon anode is formed of graphite.

BRIEF DESCRIPTION OF THE DRAWING

These and other objects, and many of the attendant features and advantages of this invention will be readily appreciated, as the same becomes better understood by reference to the following detailed description of illustrative embodiments when considered in connection with the accompanying drawing, in which.

DETAILED DESCRIPTION OF THE PREFERRED EMBODIMENTS

To further clarify the present invention, illustrative embodiments of the present invention will be described in detail with reference to the accompanying drawings, in which Embodiment (A) relates to a process of producing an alloy of terbium and an apparatus therefor, Embodiment (B) relates to a process of producing an alloy of gadolinium and an apparatus therefor, and Embodiment (C) relates to a process of producing an alloy of terbium and gadolinium (i.e., an alloy containing terbium and gadolinium) and an apparatus therefor.

Figure 1:
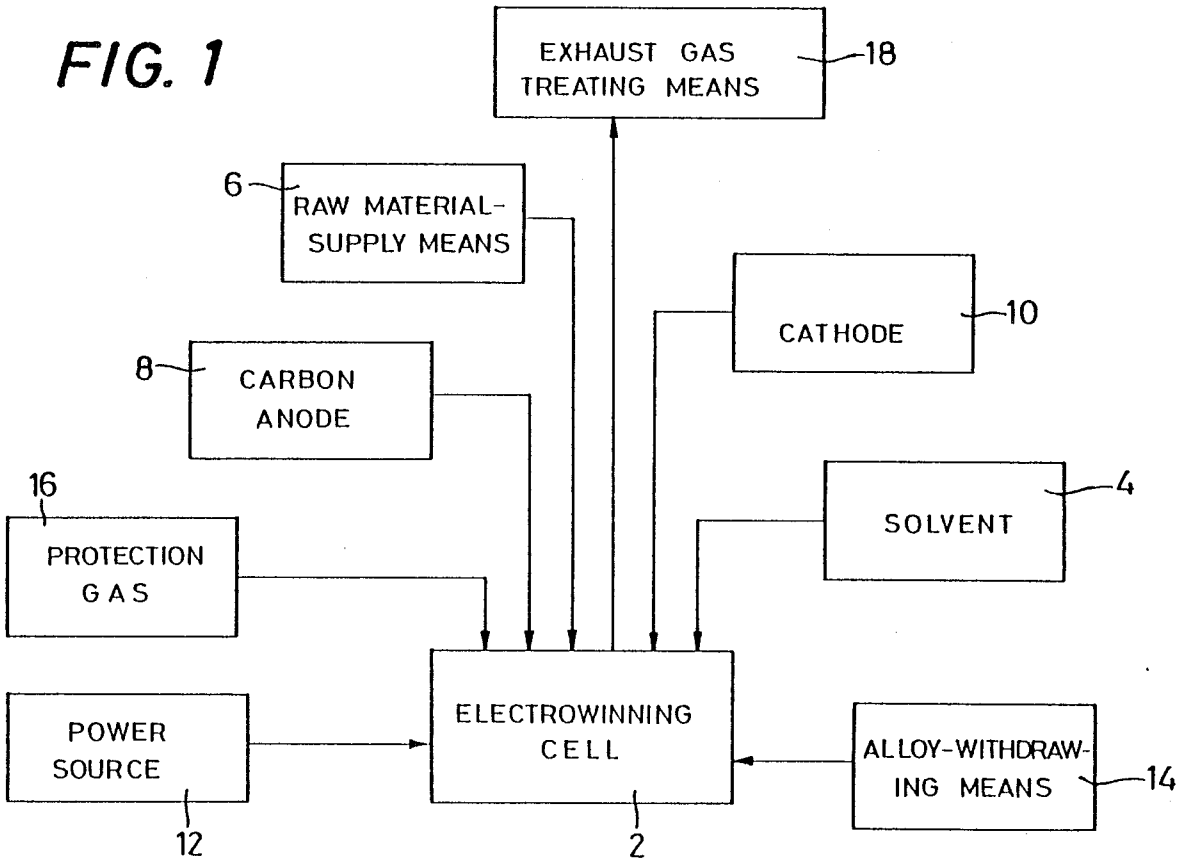
FIG. 1 is a schematic diagram of an arrangement of the electrolysis system for realizing a process of the present invention.

An electrowinning cell 2, which is a principal part of the electrolysis or electrowinning system illustrated in the schematic diagram of FIG. 1, is to contain in it a solvent 4 constituting an electrolyte bath or mixed molten salts. As the solvent 4, a mixture of terbium fluoride ($TbF_3$) and lithium fluoride (LiF) is used for Embodiment (A), while a mixture of gadolinium fluoride ($GdF_3$) and lithium fluoride (LiF) is used for Embodiment (B). For Embodiment (C), a mixture of terbium fluoride, gadolinium fluoride and lithium fluoride is used as the solvent 4. In each of the three embodiments, it is possible to optionally add barium fluoride ($BaF_2$) and calcium fluoride ($CaF_2$), individually or simultaneously as needed. The electrolysis raw material is supplied from a raw material-supply means 6 into the electrolyte bath in the electrowinning cell 2. As the raw material, terbium fluoride is used for Embodiment (A), in place of the traditional raw material, terbium oxide ($Tb_4O_7$), and the terbium fluoride is at the same time one component of the electrolyte bath. For Embodiment (B), gadolinium fluoride is used as the raw material, in place of the traditional gadolinium oxide ($Gd_2O_3$), while for Embodiment (C) a mixture of terbium fluoride and gadolinium fluoride is used, in place of terbium oxide and gadolinium oxide, as the raw material. The gadolinium fluoride for Embodiment (B) and the terbium fluoride and gadolinium fluoride for Embodiment (C) is(are) at the same time a component(s) of the electrolyte bath for Embodiment (B) and Embodiment (C), respectively.

In the electrolyte bath contained in the electrowinning cell 2, an anode or anodes 8 and a cathode or cathodes 10 are respectively inserted to be immersed therein. The anodes 8 are made of carbon, and the cathodes 10 are made of metal, such as iron and cobalt. Between the anodes 8 and the cathodes 10 direct current is applied with a power source 12 so as to carry out electrolytic reduction of the raw material, terbium fluoride, gadolinium fluoride, or the mixture of terbium fluoride and gadolinium fluoride. Metallic terbium, metallic gadolinium, or metallic terbium and metallic gadolinium, electrodeposited on the cathodes 10, will immediately produce an alloy, in a liquid state, together with the alloying metal constituting the cathodes 10. The liquid alloy produced on the cathodes 10 will drip one after another into a receiver placed in the electrolyte bath in the electrowinning cell 2 and will make a molten pool therein. Since the produced alloy on the cathodes 10 becomes liquid at the temperature where the electrolyte is fused, and specific gravity of the electrolyte bath is chosen smaller than that of the produced alloy, the liquid alloy drips readily one after another off the surface of each cathode 10 as it is formed there.

The liquid alloy, collected in this manner in the receiver which is located below the cathodes 10 and the mouth of which is open upward, is withdrawn from the electrowinning cell 2 with a suitable siphoning means, i.e., alloy-withdrawing means 14 so as to be recovered.

In Embodiment (C) for producing an alloy containing terbium and gadolinium, a mixture of terbium fluoride and gadolinium fluoride is used as the electrolysis raw material, instead of terbium oxide and gadolinium oxide, as stated previously. The studies conducted by the inventors et al. have revealed that, in Embodiment (C), the alloy produced on the cathode has a chemical composition whose terbium relative to gadolinium is slightly richer than terbium fluoride relative to gadolinium fluoride of the electrolyte bath. Therefore, a desired alloy whose composition has a desired ratio of terbium to gadolinium, can be continuously obtained by supplying to the electrolyte bath a mixture of terbium fluoride and gadolinium fluoride having the same ratio of terbium fluoride to gadolinium fluoride as that of the electrolyzed or consumed mixture of the two fluorides, and thereby maintaining the terbium to gadolinium ratio of the electrolyte bath during the electrolysis operation.

Further, protection gas 16 is introduced into the electrowinning cell 2 for the purpose of preventing the electrolyte bath, the produced alloy, the anodes 8 and the cathodes 10, and the structural meterials of the cell from being deteriorated, and also of avoiding the pickup of harmful impurities and non-metallic inclusions in the produced alloy. A gas or gases produced in the electrowinning cell 2 in the course of the electrolytic reduction are introduced into an exhaust gas-treating means 18 together with the protection gas 16 for being placed under a predetermined treatment.

In the electrolysis system of the present invention, terbium fluoride, gadolinium fluoride, or a mixture of terbium fluoride and gadolinium fluoride is used as the electrolysis raw material, instead of terbium oxide gadolinium oxide, or a mixture of terbium oxide and gadolinium oxide. Since the terbium fluoride, the gadolinium fluoride, or the mixture of terbium fluoride and gadolinium fluoride, being the raw material, is in this system a principal component of the electrolyte bath at the same time, supplementing the same in the bath as it is consumed in the course of electrolysis is relatively easy. Another merit of use of the fluoride or fluorides, used as the raw material, resides in that it allows continuation of the electrolysis in far wider a range of raw material concentration in the bath as compared with in the oxide(s) electrolysis. As to the way of supplementing the raw material, sprinkling powder of terbium fluoride, gadolinium fluoride, or the mixture of the two fluorides over the surface of the electrolyte bath is quite common and preferable because of its easier dissolution into the bath. It is, however, allowable to introduce it into the bath together with a gas, or to immerse a compressed powder briquette. Another advantage of the use of the fluoride or fluorides superior to the oxide or oxides as the raw material is far wider a range of allowance in the electrolytic raw material concentration observed within the interpolar electrolysis region in the bath. Continuation of the electrolytic operation, being provided with a wider allowance range in the raw material concentration in the bath, is not affected so much by a delay of raw material feed to this interpolar region. In comparison with the traditional operation using the oxide or oxides, the invented method using the fluoride or fluorides, with far wider a region of allowance in regards to its concentration, is relieved to a large extent from restrictions on the raw material supply position and on the raw material supply rate depending upon the current applied.

According to the invention, in the manufacturing of alloys of terbium, alloys of gadolinium, or alloys of terbium and gadolinium, having a low content of impurities and having a low content of non-metallic inclusions, it is required to maintain the electrolysis temperature as low as practicable. For this purpose, a mixture of molten salts consisting substantially of 20–95% by weight of terbium fluoride, gadolinium fluoride, or a mixture of terbium fluoride and gadolinium fluoride, 5–80% by weight of lithium fluoride, 0–40% by weight of barium fluoride and 0–20% by weight of calcium fluoride (tatal of the terbium fluoride or the gadolinium fluoride or the two fluorides mixture, the lithium fluoride, the barium fluoride, and the calcium fluoride amounts to substantially 100%) is selected as the electrolyte bath. Even when the raw material of terbium fluoride, gadolinium fluorde, or the fluorides mixture is added to the electrolyte bath, the bath must be adjusted so as to maintain during the entire process of electrolysis the above-mentioned composition.

In regard to the composition of the components of the electrolyte bath, lowering the concentration of the terbium fluoride, gadolinium fluoride, or the two fluorides mixture below the lowest limit, i.e., less than 20% will deteriorate the electrolysis results, and raising the concentration beyond the highest limit, i.e., higher than 95% will problematically increase the melting point of the bath. As to the concentration of lithium fluoride, excessive lowering thereof will raise the melting point of the bath, and excessive raising thereof will make the mutual interaction between the produced alloy and the bath too vigorous, thereby causing deterioration of the electrolysis results. Therefore, the concentration of the lithium fluoride must be adjusted in the range of 5–80%.

Adding the barium fluoride and/or the calcium fluoride is aimed at decreasing the amount of use of the expensive lithium fluoride and also aimed at the adjustment of the melting point of the mixed electrolyte bath. Excessive addition of them tends to raise the melting point of the bath, so the concentration of the former must be limited up to 40% and that of the latter to 20%, although they may be used either singly or parallelly. In any way the electrolyte bath must always be so composed of as to make the sum of the components, i.e., terbium and/or gadolinium fluoride(s), lithium fluoride, barium fluoride and calcium fluoride, to be substantially 100%. It is preferable again, when the electrolyte bath is composed only of terbium and/or gadolinium fluoride(s) and lithium fluoride, to adjust the concentration of the former to more than 25% and that of the latter to more than 15%. The composition of the electrolyte bath must be selected, so that the specific gravity of the bath may be smaller than that of the produced alloy such as a terbium-iron alloy, terbium-cobalt alloy, gadolinium-iron alloy, gadolinium-cobalt alloy, terbium-gadolinium-iron alloy, and terbium-gadolinium-cobalt alloy. The alloy produced on the cathode can drip off the cathode into the alloy receiver with an opening, located below the cathode, because of this difference of the specific gravity between the two.

The temperature of the electrolyte bath is preferably adjusted during electrolysis depending upon what kind of alloy to be produced. The temperature is maintained at 860°–1000° C. for a terbium-iron alloy; 710–1000 for a terbium-cobalt alloy; 850–1000 for a gadolinium-iron alloy; 800–1000 for a gadolinium-cobalt alloy; 850–1000 for a terbium-gadolinium-iron alloy; and 710–1000 for a terbium-gadolinium-cobalt alloy. At an excessively high termperature, impurities and foreign matter can enter into the products beyond the allowable limit. On the other hand, at an excessively low temperature and in the case of use of iron cathodes, the metal(s) produced on the cathode, that is, terbium, gadolinium, or terbium and gadolinium is(are) not fully fused with the iron of the cathode, since the eutectic temperature of the terbium-iron alloy, gadolinium-iron alloy, and terbium-gadolinium-iron alloy is about 845° C., about 850° C., and about 850° C. (estimated), respectively. In this case, metallic terbium, or metallic gadolinium, or metallic terbium and gadolinium, each having a relatively high melting point, is electrodeposited in a solid state on the cathode. The solid metal produced on the cathode often causes interpolar short-circuiting, and finally hinders continuation of the electrolysis operation. Further, in the case where alloys of cobalt, such as terbium-cobalt alloy, gadolinium-cobalt alloy, and terbium-gadolinium-cobalt alloy, are produced using cobalt cathodes, it becomes difficult at an excessively low temperature to maintain the composition of the electrolyte bath to be uniform, thereby deteriorating the nature of the bath and finally hindering a continuous electrolysis operation. It goes without saying that at the lowest possible temperature within the above-mentioned range can be manufactured the purest possible alloy that has the least possible impurities and non-metallic inclusions as coming from the structural materials of the electrowinning cell.

Within the above-mentioned temperature limits, alloys of high content of terbium, such as a terbium-iron alloy and a terbium-cobalt alloy each containing more than 80% by weight of terbium, can be manufactured, and the produced alloy forms liquid metal in the receiver. Similarly, alloys of high content of gadolinium, such as a gadolinium-iron alloy and a gadolinium-cobalt alloy each containing more than 60% by weight of gadolinium, and alloys of high content of terbium and gadolinium, such as a terbium-gadolinium-iron alloy and a terbium-gadolinium-cobalt alloy each containing more than 70% (in total) by weight of terbium and gadolinium, can be manufactured. Each of the molten alloys can be effectively siphoned or withdrawn from the electrowinning cell by vacuum suction. It is also possible to tap it from the bottom of the cell by flowing-down by gravity. In either way of the withdrawing of the alloy, it needs not to be heated at all, because it can be withdrawn easily in the liquid state as it is.

As to the electrodes used in the electrolysis in the present invention, it is preferable to use the cathode made of a metal that can give an alloy with terbium and/or gadolinium. Iron or cobalt is preferably used as material for the cathode. For the anode, carbon, in particular, graphite is used. Metal used for the cathode must be of low content of impurities because such impurities are easily introduced into the produced alloy. In all Embodiments (A), (B), and (C), the cathode is consumed during the electrolysis operation so as to form the alloy. Compensation for the consumption of the cathode by means of gradual immersion of the same into the electrolyte bath will, however, enable to continue, without interruption, the electrolysis, i.e., manufacturing of the alloy. In this case the metallic material as the cathode may be connected one after another by forming threadings on both the ends, which makes it easy to continuously compensate for the consumption of the cathode. Use of such a solid cathode is, in comparison with a molten metal cathode, far more convenient in handling and is very advantageous for simplifying the structure of the electrowinning cell. It naturally allows the electrowinning cell to be enlarged, to a great advantage in a case of industrialization.

In the electrolysis of the terbium fluoride using carbon anodes in this invention, it is desirable to maintain the current density over the whole immersion surface of the anodes within the range of 0.05–10.0 A/cm$^2$ during all the time of the electrolysis operation. Similarly, the current density of the anodes is maintained under the same conditions withing the range of 0.05–4.0 A/cm$^2$ for the electrolysis of the gadolinium fluoride and the mixture of terbium fluoride and gadolinium fluoride. When the current density is excessively small, it means either that the immersion surface of the anode is too large or that the current per unit area of the anode surface is too small, which deteriorates the productivity, with a result of industrial demerit. On the other hand, raising the current density to too high a level tends to bring about the anode effect which has been observed in the electrolysis using the oxide or oxides as the raw material, or some other similar abnormal phenomena. It is therefore recommendable in the invention to maintain the anode current density within the above-mentioned range, as one of the required conditions for the electrolysis, so as to effectively prevent occurrence of such abnormal phenomena. In Embodiment (B), it is more preferable to keep the current density between 0.1 and 3.0 A/cm$^2$ over the whole immersion surface of the anodes, from the consideration of possible variation of the current density on a local area thereof. Similarly, in Embodiments (A) and (C) it is more preferable to keep the current density between 0.1 and 8.0 A/cm$^2$ over the whole immersion surface of the anodes, from the same consideration. At the same temperature, the fluoride or fluorides, used as the raw material for the electrolysis, permits the anode to have a higher current density than the oxide or oxides. This is advantageous in a case of industrialization.

As to the current density on the cathode in this invention a fairly broad range such as 0.50–80 A/cm$^2$ is allowed over the whole immersion surface thereof, for the three embodiments. When the current density on the cathode is too low, however, the current per unit surface area of the cathode becomes too small, deteriorating the productivity to the extent of being industrially impractical; when it excessively rises, on the contrary, electrolytic voltage rises so much as to deteriorate the electrolysis results. In the actual electrolysis operation in the production line it is preferable, for all the embodiments, to keep the cathode current density in a narrower range, 1.0–30 A/cm$^2$, which facilitates keeping the voltage fluctuation small and makes the electrolysis operation easy and smooth.

Regarding the electrodes, the anode is in the present invention provided as a carbon anode independently, not letting the bath container or crucible, which is made of a material resistant to the corrosive action of the bath, function simultaneously as the anode, so consumption of the anode does not necessarily require stoppage or interruption of the operation as in the case of the crucible anode. A separately provided anode may be compensated for the consumption thereof by immersing the same deeper into the bath as it shortens. When a plurality of anodes are provided, they can be replaced one by one as they shorten. As to the cathode, consumption can be compensated is a similar fashion in all the embodiments only by the deeper immersion of the same or by the replacement thereof. As to the arrangement or configuration of both electrodes, it is preferable in the present invention, to set a plurality of anodes around each cathode so that the former can face the latter, taking advantage of the fairly large difference of the current density between the anode and the cathode. In that case, replacement of the anodes is an easy task, allowing their successive replacement and thereby never interrupting the alloy-producing operation. The benefits of the electrolysis process can be herewith fully realized. It is also practically very convenient that both the anodes and cathodes retain their constant and uniform shapes in their longitudinal direction, which facilitates their continuous and successive use, by being replaced in turn.

An electrowinning cell of the above-described embodiments will be further described with reference to a preferable form illustrated in a schematic sectional view of FIG. 2.

The cell 20 is composed of a lower main cell 22 and a lid body 24 covering the opening of the former. The outer sides of these two members 22 and 24 are covered by metallic outer shells 26, 28, respectively. Usually, the outer shells 26, 28 are made of steel or the like. Both the lower main cell 22 and the lid body 24 are respectively provided, inside the outer shells 26, 28, with double lining layers laid one on the other, the outer layer being a refractory heat-insulating layer 30, 32 made of brick or castable alumina, etc., and the inner layer being a layer 34, 36 which is resistant to the bath and is made of graphite, carbonaceous stamping mass, or the like.

The inner side of the corrosion-resistant material layer 34 is further provided with a lining member 38 for covering the potentially bath-contacting surface thereof. The lining member 38 functions to prevent entering of trace of impurities coming from the corrosion-resistant layer 34, and when it is made of a refractory metal such as tungsten, molybdenum, etc., it can work at the same time as the earlier mentioned receiver for the dipping alloy. However, it is recommended in the present invention to use an inexpensive iron material for the lining member 38. Studies by the inventors et al. came to a discovery that the inexpensive iron has unexpected excellent corrosion resistance to the action of the electrolyte bath, i.e., fused fluoride salts and that it can be a suitable lining member in the case of electrolyte bath of fluorides. It is permissible to omit the layer 34, since the lining member 38 can be directly applied on the refractory heat-insulating layer 30.

Passing through the lid body 24, one or plural metal cathodes 40 and a plurality of carbon anodes 42, arranged to face each cathode 40, are set such that both 40, 42 may be immersed into the electrolyte bath of predetermined molten salts contained in the lower main cell 22 by the length or distance appropriate to produce a predetermined current density on each of the electrodes. The only two carbon anodes 42, 42, which should be arranged to face the cathode 40, are illustrated in the drawing. As the material for the cathodes, a metal which is easily alloyed with terbium and/or gadolinium is used, such as iron, cobalt, copper, nickel, manganese, chrome, and titanium. The recommended material for the anodes is graphite.

Those carbon anodes 42 may be used in a variety of shapes, such as a rod form, a plate form, a pipe form, etc. They may also is fluted, as be well known, with the object of lowering the anode current density by enlarging the anode surface area of the immersed portion thereof in an electrolyte bath 44. The carbon anodes 42 in FIG. 2 are slightly tapered on the immersed portion thereof in order to show trace of the anode consumption. Those anodes 42 may be provided with a suitable electric lead-bar of metal or a like conductive material for the purpose of power-supplying. They are also equipped with an ascent-and-descent device 46, with which they can be moved up and down into the bath and also can be adjusted continuously or intermittently as to the length of the immersed portion thereof so as to surely maintain the required anode current density. In other words, the surface area of the immersed portion, on which the anode current density under a continuous and constant current depends, is adjusted through the length thereof. The ascent-and-descent device 46 may also function, at the same time, as an electric contact for the anode.

The cathode or cathodes 40 are, on the other hand, made of cobalt, iron or other metal that is alloyed with the metallic terbium and/or gadolinium electrodeposited on the cathode through the electrolytic reduction. In FIG. 2 only one cathode 40 is illustrated, and its immersed portion is shown as a cone, which indicates the cathode consumption due to dripping of the produced alloy. The cathode 40 takes a solid form, as the electrolysis temperature is selected below the melting point of the iron cathode 40, and may be a wire, a rod, or a plate in its shape. This cathode 40 is also equipped with an ascent-and-descent device 48, with which it is introduced into the bath 44 continuously or intermittently so as to compensate for the consumption thereof due to the alloy formation. The ascent-and-descent device 48 can simultaneously work as an electric contact. It is permissible to protect the non-immersed portion thereof with a sleeve or the like, from corrosion.

For the purpose of receiving the alloy thus produced on the tip of the cathode 40, a receiver 50 is placed, in the bath 44, on the bottom of the lower main cell 22, with an opening or mouth thereof just below the cathode 40. A drop-formed liquid alloy 52, produced on the tip of the cathode 40 by the electrolytic reduction, drips off the cathode 40 and falls down to be collected in the receiver 50. This receiver 50 may be made of a refractory metal such as tungsten, tantalum, molybdenum, niobium, or their alloy, with small reactivity to the produced alloy 52, or the receiver 50 may be made of ceramics made of borides like boron nitride or of oxides or cermet.

The electrolyte bath 44 is a fused salt solution of a fluorides mixture containing terbium fluoride and/or gadolinium fluoride therein with an adjusted composition according to the present invention, and its composition is so selected as to make the specific gravity thereof to be smaller than that of the produced alloy. The electrolysis raw material which is consumed through the electrolytic operation is supplemented by feeding it from a raw material-supply means 54 through a material-supply hole 56 formed in the lid body 24 so as to prepare and maintain the electrolyte bath 44 of a predetermined preferable composition.

As mentioned earlier the produced alloy 52, which drips off the metal cathode 40 to be reserved in the receiver 50, is, when the reserved amount reaches a predetermined amount, withdrawn in a liquid state from the electrowinning cell 20 by a predetermined alloy siphoning or tapping system. An alloy-siphoning system such as illustrated in FIG. 2 is preferably used for this purpose, wherein a pipe-like vacuum suction nozzle 58 is inserted, through a produced alloy-suction hole 60 formed in the lid body 24, into the electrolyte bath 44, such that the lower end of the nozzle 58 can be immersed into the produced alloy 52 in the alloy receiver 50, and the alloy 52 is withdrawn, through sucking action of a vacuum means (not illustrated), from the electrowinning cell 20.

It is also permissible here to install an alloy tapping or flowing-out system, in place of the alloy siphoning system for withdrawing the alloy 52 by evacuation, which is provided with a tapping pipe, passing through the wall of the electrowinning cell 20 (lower main cell 22) and further passing through the wall of the alloy receiver 50, for having its opening in the alloy receiver 50, so as to flow the alloy 52 down out of the lower main cell 22 by gravity.

There is a not-illustrated protection gas-supplying device, in the present invention, for supplying protection gas into the cell 20 such that any gas or gases generated in the course of electrolysis operation may be discharged together with the protection gas through an exhaust gas outlet port 62. It goes without saying that a heating device may be equipped therewith, when needed, inside or outside the cell 20 for maintaining the electrolysis temperature at a desired level, although the heating device is not shown in the drawings.

There will be described some examples of the present invention, which however are shown for illustrative purpose only, and in which Examples 1 and 2 relate to Embodiment (A) for producing alloys of terbium, Examples 3 and 4 relate to Embodiment (B) for producing alloys of gadolinium, and Examples 5 and 6 relate to Embodiment (C) for producing alloys of terbium and gadolinium.

The present invention can be practiced in variety of ways other than the above-mentioned description and the disclosed embodiments as well as the following examples, based on the knowledge of those skilled in the art, within the limit and spirit thereof. All of those varieties and modifications should be understood to be included in this invention.

EXAMPLE 1

Figure 2:
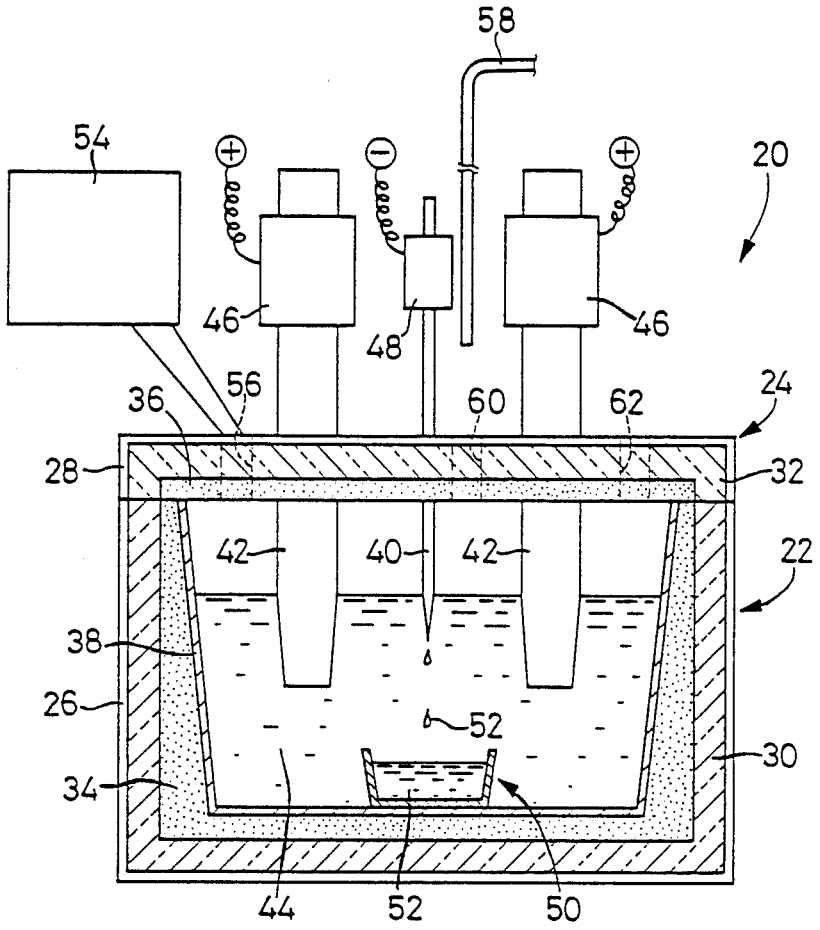
FIG. 2 is a sectional view for illustrating a structure of an example of the electrowinning cell, with which the present invention is realized.

A rare earth-iron (RE-Fe) alloy, 0.49 kg, with a composition of 89% by weight of rare earth metals including terbium for the most part and 11% by weight of iron was obtained by the following process:

An electrolyte bath consisting substantially of two fluorides, i.e., terbium fluoride and lithium fluoride was electrolyzed, at an average temperature 900° C., in an inert gas atmosphere with an electrowinning cell of the type shown in FIG. 2. A graphite crucible was used as the cell, which crusible was lined by a lining member made of a ferrous material resistive to the bath. An alloy receiver made of boron nitride (BN) was placed in the middle portion of the bottom of the graphite crucible. A single wire-like vertical iron cathode with 6 mmϕ was immersed in the bath in the middle portion of the graphite crucible, while four rod-like vertical graphite anodes with 40 mmϕ were immersed in the bath in a concentrical (in the plane view) arrangement around the single cathode.

Powdered terbium fluoride as the raw material was continuously supplied so as to maintain the electrolysis operation for 8 hours under the operation conditions shown in Table I. All the time during this operation, the electrolysis was satisfactorily continued, during which time a liquid alloy of rare earth (terbium) with iron was produced which dripped and was collected in the BN receiver placed in the bath. The alloy was siphoned from the cell with a vacuum suction type alloy siphoning system having a nozzle.

The electrolysis results and the analysis results of the obtained alloy are shown in Table I and Table II, respectively. Values of current efficiency (%) shown in Table I were determined based upon the weight of rare earth metals obtained, on the assumption that the rare earth metals include terbium only.

EXAMPLE 2

A rare earth(terbium)-cobalt alloy, 0.58 kg, with a composition of 80% of rare earth metals consisting substantially of terbium and 20% of cobalt, was obtained by way of the following electrolysis operation.

A lining of iron was applied inside a container of graphite crucible in the cell. An alloy receiver made of molybdenum was placed in the middle portion of the bottom of the graphite crucible. A mixture substantially consisting of terbium fluoride and lithium fluoride, as the electrolyte bath, was electrolyzed at an average temperature 790° C. in an inert gas atmosphere. A single rod-like vertical cobalt cathode with 6 mmϕ was arranged in the similar manner as in Example 1. Four of rod-like vertical graphite anodes with 40 mmϕ were used just like in Example 1.

The raw material of terbium fluoride was continuously supplied into the bath during the electrolysis operation of 8 hours under the conditions in Table I. The process progressed satisfactorily, and the produced rare earth(terbium)-cobalt alloy was reserved in the molybdenum receiver, having dripped thereinto one after another during the operation. The alloy could be siphoned in a liquid state as in Example 1.

The electrolysis results and the analysis results of the alloy produced by this method are shown, respectively, in Table I and Table II.

TABLE I

| | | Example 1 | Example 2 |
|---|---|---|---|
| Conditions for Electrolysis | Current (A) | 50 | 50 |
| | Time (hr) | 8 | 8 |
| | Composition of Bath | | |
| | $TbF_3$ (wt %) | 74 | 74 |
| | LiF (wt %) | 24 | 24 |
| | Temperature (°C.) | 891–907 | 715–920 |
| | Anode Current Density (A/cm$^2$) | 0.08–0.65 | 0.06–0.76 |
| | Cathode Current Density (A/cm$^2$) | 3.0–40.1 | 2.0–10.6 |
| Electrolysis Results | Average Voltage (V) | 7.5 | 7.9 |
| | Current Efficiency (%) | 55 | 59 |
| | Produced Alloy | | |
| | Weight (kg) | 0.49 | 0.58 |
| | TRE Content (%)* | 89 | 80 |

*TRE Content means a total of contents of all the rare earth metals contained by the produced alloy; terbium for the most part.

TABLE II

| Examples | TRE* (%) | Fe (%) | Co (%) | Ca (%) | Al (%) | Si (%) | O (%) |
|---|---|---|---|---|---|---|---|
| Example 1 | 89 | 11 | <0.01 | <0.01 | <0.01 | <0.01 | <0.01 |
| Example 2 | 80 | <0.01 | 20 | <0.01 | <0.01 | <0.01 | <0.01 |

*TRE Content means a total of contents of all the rare earth metals contained by the produced alloy; terbium for the most part.

EXAMPLE 3

A rare earth-iron (RE-Fe) alloy, 0.54 kg, with a composition of 87% by weight of rare earth metals including gadolinium for the most part and 13% by weight of iron was obtained by the following process.

An electrolyte bath consisting substantially of two fluorides, i.e., gadolinium fluoride and lithium fluoride was electrolyzed, at an average temperature 885° C., in an inert gas atmosphere with an electrowinning cell of the type shown in FIG. 2. As the cell, was used a graphite crucible which is lined by a lining member made of a ferrous material resistive to the bath. An alloy receiver made of boron nitride (BN) was placed in the middle portion of the bottom of the graphite crucible. A single wire-like vertical iron cathode with 6 mmϕ was immersed in the bath in the middle portion of the graphite crucible, while four of rod-like vertical graphite anodes with 40 mmϕ were immersed in the bath in a concentrical (in the plane view) arrangement around the single cathode.

Powdered gadolinium fluoride as the raw material was continuously supplied so as to maintain the electrolysis operation for 8 hours under the operation conditions shown in Table III. All the time during this operation, the electrolysis was satisfactorily continued, during which time a liquid alloy of rare earth (gadolinium) with iron was produced which dripped and was collected in the BN receiver placed in the bath. The alloy was siphoned from the cell with a vacuum suction type alloy siphoning system having a nozzle.

The electrolysis results and the analysis results of the obtained alloy are shown in Table III and Table IV, respectively. Values of current efficiency (%) shown in Table III were determined based upon the weight of rare earth metals obtained, on the assumption that the rare earth metals include gadolinium only.

EXAMPLE 4

A rare earth(gadolinium)-cobalt alloy, 0.53 kg, with a composition of 83% of rare earth metals consisting substantially of gadolinium and 17% of cobalt, was obtained by way of the undermentioned electrolysis operation.

A lining of iron was applied inside a container of graphite crucible in the cell. An alloy receiver made of tungsten was placed in the middle portion of the bottom of the graphite crucible. A mixture substantially consisting of gadolinium fluoride and lithium fluoride, as the electrolyte bath, was electrolyzed at an average temperature 831° C. in an inert gas atmosphere. A single D rod-like vertical cobalt cathode with 6 mmϕ was arranged in the similar manner as in Example 3. Four of rod-like vertical graphite anodes with 40 mmϕ were used just like in Example 3.

The raw material of gadolinium fluoride was continuously supplied into the bath during the electrolysis operation of 8 hours under the conditions in Table III. The process progressed satisfactorily, and the produced rare earth(gadolinium)-cobalt alloy was reserved in the tungsten receiver, having dripped thereinto one drop after another during the operation. The alloy could be siphoned in a liquid state as in Example 3.

The electrolysis results and the analysis results of the produced alloy are shown respectively in Table III and Table IV.

TABLE III

| | | Example 3 | Example 4 |
|---|---|---|---|
| Conditions for Electrolysis | Current (A) | 50 | 50 |
| | Time (hr) | 8 | 8 |
| | Composition of Bath | | |
| | $GdF_3$ (wt %) | 76 | 76 |
| | LiF (wt %) | 24 | 24 |
| | Temperature (°C.) | 856–910 | 801–870 |
| | Anode Current Density (A/cm$^2$) | 0.10–0.50 | 0.05–0.31 |
| | Cathode Current Density (A/cm$^2$) | 1.0–35.0 | 0.8–20.1 |
| Electrolysis Results | Average Voltage (V) | 7.8 | 7.9 |
| | Current Efficiency (%) | 60 | 56 |
| | Produced Alloy | | |
| | Weight (kg) | 0.54 | 0.53 |
| | RE* (%) | 87 | 83 |

*RE: A total of contents of the rare earth metals

TABLE IV

| Examples | RE* (%) | Fe (%) | Co (%) | Ca (%) | Al (%) | Si (%) | O (%) |
|---|---|---|---|---|---|---|---|
| Example 3 | 87 | 13 | <0.01 | <0.01 | <0.01 | <0.01 | <0.01 |
| Example 4 | 83 | <0.01 | 17 | <0.01 | <0.01 | <0.01 | <0.01 |

*RE: A total of contents of the rare earth metals (gadolinium for the most part)

EXAMPLE 5

A rare earth-cobalt (RE-Co) alloy, 0.52 kg, with a composition of 80% by weight of rare earth metals including terbium and gadolinium for the most part and 20% by weight of cobalt was obtained by the following process.

An electrolyte bath made substantially of three fluorides, i.e., terbium fluoride, gadolinium fluoride and lithium fluoride was electrolyzed, at an average temperature 840° C., in an inert gas atmosphere with an electrowinning cell similar to that shown in FIG. 2. A graphite crucible was used as the cell. An alloy receiver made of boron nitride was placed in the middle portion of the bottom of the graphite crucible. A single wire-like vertical cobalt cathode with 6 mmϕ was immersed in the bath in the middle portion of the graphite crucible, while four rod-like vertical graphite anodes with 40 mmϕ were immersed in the bath in a concentrical (in the plane view) arrangement around the single cathode.

A powdered mixture of terbium fluoride and gadolinium fluoride as the raw material was continuously supplied so as to maintain the electrolysis operation for 8 hours under the operation conditions shown in Table V. All the time during this operation, the electrolysis was satisfactorily continued, during which time a liquid alloy of rare earth (terbium and gadolinium) with cobalt was produced which dripped and was collected in the boron-nitride receiver placed in the bath. The alloy was siphoned from the cell with a vacuum suction type alloy siphoning system having a nozzle.

The electrolysis results and the analysis results of the produced alloy are shown respectively in Table V and Table VI.

EXAMPLE 6

A rare earth (terbium and gadolinium)-iron alloy, 0.41 kg, with an average composition of 88% of rare earth metals including terbium and gadolinium for the most part and 12% of iron was obtained by way of the undermentioned electrolysis operation.

A lining of iron was applied inside a container of graphite crucible in the cell. An alloy receiver made of boron nitride was placed in the middle portion of the bottom of the graphite crucible. A mixture substantially consisting of three fluorides, i.e., terbium fluoride, gadolinium fluoride, and lithium fluoride, as the electrolyte bath, was electrolyzed at an average temperature 900° C. in an inert gas atnosphere. A single wire-like vertical iron cathode with 6 mmϕ was arranged in the similar manner as in Example 5. Four of rod-like vertical graphite anodes with 40 mmϕ were used just like in Example 5.

The raw material, a mixture of terbium fluoride and gadolinium fluoride, was continuously supplied into the bath during the electrolysis operation of 8 hours under the conditions in Table V. The process progressed satisfactorily, and the produced alloy of rare earth (terbium and gadolinium) with iron was reserved in the boron-nitride receiver, having dripped thereinto during the operation. The alloy could be siphoned in a liquid state as in Example 5.

The electrolysis results and the analysis results of the produced alloy are shown respectively in Table V and Table VI.

TABLE V

| | | Example 5 | Example 6 |
|---|---|---|---|
| Conditions for Electrolysis | Current (A) | 50 | 50 |
| | Time (hr) | 8 | 8 |
| | Composition of Bath | | |
| | $GdF_3$ (wt %) | 57 | 32 |
| | $TbF_3$ (wt %) | 9 | 30 |
| | LiF (wt %) | 34 | 38 |
| | Temperature (°C.) | 800–990 | 875–920 |
| | Anode Current Density (A/cm$^2$) | 0.05–0.4 | 0.1–0.4 |
| | Cathode Current Density (A/cm$^2$) | 1.0–12.0 | 3–5.6 |
| Electrolysis Results | Average Voltage (V) | 7.4 | 7.2 |
| | Current Efficiency (%)* | 53 | 46 |
| | Produced Alloy | | |
| | Weight (kg) | 0.52 | 0.41 |
| | RE Content(%) | 80 | 88 |

*Current Efficiency (%) means a ratio of theoretical to actual amounts of electricity required to reduce gadolinium and terbium; the theoretical amounts of electricity are determined based upon the chemical composition and weight of the alloy obtained.

TABLE VI

| Examples | Gd (%) | Tb (%) | Fe (%) | Co (%) | Al (%) | Ca (%) | O (%) |
|---|---|---|---|---|---|---|---|
| Example 5 | 64 | 16 | <0.01 | 20 | <0.01 | <0.01 | <0.01 |
| Example 6 | 40 | 48 | 12 | <0.01 | <0.01 | <0.01 | <0.01 |

As can be evidently observed in Table I through Table VI, alloys richly containing terbium and gadolinium, such as a terbium-iron alloy, terbium-cobalt alloy, gadolinium-iron alloy, gadolinium-cobalt alloy, terbium-gadolinium-iron alloy, and terbium-gadolinium-cobalt alloy, can be produced easily through an electrolysis operation using terbium fluoride and/or gadolinium fluoride, in only one step. It is also clearly recognized in these tables, that the alloys produced in the invented method contain little impurities such as calcium or oxygen which are known to have a detrimental effect on the properties of the produced alloys.

With regard to all the examples described above, it is easy to continue the experiments longer exceeding the time durations shown in the tables, and similar results to those tabulated in the tables have been ascertained even in the said elongated experiment.

What is claimed is:

1. A process of producing an alloy containing terbium and/or gadolinium, comprising the steps of:

preparing a bath of molten electrolyte which has a composition consisting essentially of 20–95% by weight of terbium fluoride and/or gadolinium fluoride, 5–80% by weight of lithium fluoride, up to 40% by weight of barium fluoride and up to 20% by weight of calcium fluoride;

effecting electrolytic reduction of said terbium and/or gadolinium fluorides in said bath of molten electrolyte, with at least one carbon anode and at least one metal cathode, so as to electrodeposit terbium and/or gadolinium on said at least one metal cathode, and alloying the electrodeposited terbium and/or gadolinium with metal of said at least one metal cathode so as to produce said alloy containing terbium and/or gadolinium in a liquid state on said at least one metal cathode;

adding said terbium and/or gadolinium fluorides to said bath of molten electrolyte so as to maintain said composition of the bath of molten electrolyte, for compensating for consumption of the terbium and/or gadolinium fluorides during production of said alloy;

dripping the liquid alloy from said at least one metal cathode into a receiver having a mouth which is open upward in a lower portion of the bath of molten electrolyte below said metal cathode, and thereby collecting said liquid alloy in the form of a molten pool in said receiver; and withdrawing said molten pool of the liquid alloy from said receiver.

2. A process according to claim 1, wherein said at least one metal cathode is formed of a metal selected from the group comprising iron, cobalt, copper, nickel, manganese, chromium, and titanium.

3. A process according to claim 1, wherein said terbium and/or gadolinium fluorides is terbium fluoride, said at least one metal cathode is formed of iron, and said alloy containing terbium and/or gadolinium is a terbium-iron alloy.

4. A process according to claim 3, wherein said bath of molten electrolyte is held at temperatures within a range of 860°–1000° C., and said electrolytic reduction is effected at said temperatures.

5. A process according to claim 1, wherein said terbium and/or gadolinium fluorides is terbium fluoride, said at least one metal cathode is formed of cobalt, and said alloy is a terbium-cobalt alloy.

6. A process according to claim 5, wherein said bath of molten electrolyte is held at temperatures within a range of 710°–1000° C., and said electrolytic reduction is effected at said temperatures.

7. A process according to claim 1, wherein said terbium and/or gadolinium fluorides is gadolinium fluoride, said at least one metal cathode is formed of iron, and said alloy is a gadolinium-iron alloy.

8. A process according to claim 7, wherein said bath of molten electrolyte is held at temperatures within a range of 850°–1000° C., and said electrolytic reduction is effected at said temperatures.

9. A process according to claim 1, wherein said terbium and/or gadolinium fluorides is gadolinium fluoride, said at least one metal cathode is formed of cobalt, and said alloy is a gadolinium-cobalt alloy.

10. A process according to claim 9, wherein said bath of molten electrolyte is held at temperatures within a range of 800°–1000° C., and said electrolytic reduction is effected at said temperatures.

11. A process according to claim 1, wherein said gadolinium and/or terbium fluorides is a mixture of terbium fluoride and gadolinium fluoride, said at least one metal cathode is formed of iron, and said alloy is a terbium-gadolinium-iron alloy.

12. A process according to claim 11, wherein said bath of molten electrolyte is held at temperatures within a range of 850°–1000° C., and said electrolytic reduction is effected at said temperatures.

13. A process according to claim 1, wherein said terbium and/or gadolinium fluorides is a mixture of terbium fluoride and gadolinium fluoride, said at least one metal cathode is formed of cobalt, and said alloy is a terbium-gadolinium-cobalt alloy.

14. A process according to claim 13, wherein said bath of molten electrolyte is held at temperatures within a range of 710°–1000° C., and said electrolytic reduction is effected at said temperatures.

15. A process according to claim 1, wherein said terbium and/or gadolinium fluorides is terbium fluoride, and said electrolytic reduction is effected by applying a direct current to said at least one carbon anode with a current density of 0.05–10.0 A/cm$^2$, and to said at least one metal cathode with a current density of 0.50–80 A/cm$^2$.

16. A process according to claim 1, wherein said terbium and/or gadolinium fluorides is gadolinium fluoride, and said electrolytic reduction is effected by applying a direct current to said at least one carbon anode with a current density of 0.05–4.0 A/cm$^2$, and to said at least one cathode with a current density of 0.50–80 A/cm$^2$.

17. A process according to claim 1, wherein said terbium and/or gadolinium fluorides is a mixture of terbium fluoride and gadolinium fluoride, and said electrolytic reduction is effected by applying a direct current to said at least one carbon anode with a current density of 0.05–10.0 A/cm$^2$, and to said at least one cathode with a current density of 0.50–80 A/cm$^2$.

18. A process according to claim 1, wherein said at least one carbon anode is formed of graphite.

19. A process according to claim 1, wherein said at least one metal cathode is an elongate solid member having a substantially constant transverse cross sectional shape over its length.

20. A process according to claim 1, wherein said at least one metal cathode is an elongate tubular member having a substantially constant transverse cross sectional shape over its length.

21. A process according to claim 1, wherein said bath of electrolyte containing said terbium and/or gadolinium fluorides consists essentially of at least 25% by weight of terbium fluoride and/or gadolinium fluoride, and at least 15% by weight of lithium fluoride.

* * * * *